US006286258B1

(12) United States Patent
Bischof et al.

(10) Patent No.: US 6,286,258 B1
(45) Date of Patent: Sep. 11, 2001

(54) MOVABLE WALL

(75) Inventors: Markus Bischof, Altenrhein; Stefan Rechsteiner, Staad, both of (CH)

(73) Assignee: DORMA GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/026,460

(22) Filed: Feb. 19, 1998

Related U.S. Application Data

(63) Continuation-in-part of application No. PCT/DE97/00899, filed on May 2, 1997.

(30) Foreign Application Priority Data

Jun. 21, 1996 (CH) ..... 1546/96

(51) Int. Cl.[7] ..... E05D 15/26; E05F 11/54

(52) U.S. Cl. ..... 49/127; 49/275; 49/128; 49/358

(58) Field of Search ..... 49/125, 127, 128, 49/362, 275, 276, 32, 358; 16/218, 202

(56) References Cited

U.S. PATENT DOCUMENTS

| | | | | |
|---|---|---|---|---|
| 3,309,816 | * | 3/1967 | Malone | 49/127 |
| 3,334,375 | * | 8/1967 | Hubbard | 16/97 |
| 3,577,679 | * | 5/1971 | Petterborg | 49/127 |
| 4,073,092 | * | 2/1978 | Williams | 49/127 |
| 4,787,119 | * | 11/1988 | Furuya | 16/102 |
| 4,897,959 | * | 2/1990 | Worden | 49/18 |
| 4,991,257 | * | 2/1991 | Eutebach | 16/87 R |
| 4,998,577 | * | 3/1991 | Kobayashi et al. | 160/202 |
| 5,022,454 | * | 6/1991 | Kobayashi et al. | 160/202 |
| 5,088,236 | * | 2/1992 | Karhu | 49/127 |
| 5,230,123 | * | 7/1993 | Williams et al. | 16/95 R |
| 5,357,651 | * | 10/1994 | Jones et al. | 16/95 R |
| 5,548,926 | * | 8/1996 | Sjoholm | 49/127 |
| 5,566,505 | * | 10/1996 | Kamezaki | 49/225 |
| 5,680,729 | * | 10/1997 | Heffington | 49/362 |
| 5,852,897 | * | 12/1998 | Sukale | 49/358 |
| 5,930,953 | * | 8/1999 | Estfeller | 49/127 |
| 6,073,394 | * | 6/2000 | Uhl | 49/41 |

FOREIGN PATENT DOCUMENTS

| | | |
|---|---|---|
| 0482090 | 1/1970 | (CH) . |
| 1509476 | 1/1969 | (DE) . |
| 2108593 | 8/1972 | (DE) . |
| 2404875 | 8/1975 | (DE) . |
| 4424660 | 9/1995 | (DE) . |
| 0437029 | 7/1991 | (EP) . |
| 0574851 | 12/1993 | (EP) . |
| 8905389 | 6/1989 | (WO) . |

* cited by examiner

*Primary Examiner*—Gregory J. Strimbu
(74) *Attorney, Agent, or Firm*—Nils H. Ljungman & Associates

(57) ABSTRACT

A movable wall has a plurality of movable wall elements mounted in horizontally oriented guide rails. The guide rail which defines the path of the movable wall elements from the parked position into the closed position is laid out in a 90 degree curve in the vicinity of a room opening to be closed so that it brings the closed movable wall elements into alignment. The final movable wall element in the direction of the closing motion is mounted on support and guidance elements. At least the rear support and guidance element of the final wall element in the direction of the closing motion, is mounted on the final movable wall element so that the rear support and guidance element can be moved along the final movable wall element. This rear support and guidance element also has its own drive unit, by which drive unit, during the closing process, the final movable wall element is automatically moved into the closed position in which it is flush with the other movable wall elements. Between the final movable wall element and a closing stop mounted on a wall, no gap remains which would have to be closed by an additional shutter.

8 Claims, 7 Drawing Sheets

MOVABLE WALL

CONTINUING APPLICATION DATA

This application is a Continuation-In-Part Application of International Application No. PCT/DE97/00899, filed on May 2, 1997, which claims priority from Swiss Patent Application No. 1546/96, filed on Jun. 21, 1996. International Application No. PCT/DE97/00899 was pending as of the filing date of this application and designated the USA as a designated state.

BACKGROUND OF THE INVENTION

1. Field of the Invention

The present invention relates generally to a movable wall, which movable wall has at least two movable wall elements. The at least two movable wall elements are mounted so that they can move on at least one stationary, horizontal guide rail by support and guidance elements.

2. Background Information

Similar movable walls can be used for a wide variety of purposes. A circulating drive chain can be provided in the vicinity of the guide rail so that when the drive is actuated, the individual movable wall elements can be driven in either direction. Depending on the specific application, the individual movable wall elements can be made of a solid panel, e.g. wood or metal, or can also be made of a translucent panel, e.g. glass. Such a movable wall can be used to divide a large room into smaller sections. Movable walls can also be used to separate storerooms and offices in shopping centers or shopping malls from the public areas. In the latter case, for example, the movable wall must be opened or closed two or four times a day. When the movable wall is open, the movable wall elements are generally parked with their flat sides parallel to one another in a "railroad yard". To close the movable wall, the movable wall elements can be moved into the closed position one after the other along the guide rail or guide rails, so that they close off a room opening between two walls. For such an application, one guide rail, for example, can be located on the ceiling and another on the floor of the room.

German Patent No. 44 24 660 C1 discloses a horizontally movable wall in which, in front of an existing guide rail in which the individual elements can be moved, an additional rail system is installed in the vicinity of the ceiling. A switchable coupling device is equipped with an identification system to locate the individual elements. The individual elements contain corresponding indicators. The switchable coupling device runs in this system of rails. The switchable coupling device moves the individual elements into the parked position in which the individual elements are pivoted by 90 degrees. The entire system is driven by an electric motor which drives an endless belt via a pulley. Together with a program-controlled system, the identification system is controlled so that after a learning cycle is performed, the identification system is able to recognize the individual elements and move the partition into the parked position or into the closed position, as required. It is also possible to realize only one partial opening, for example, to avoid opening the entire facade in cold weather. The switchable coupling device consists of an electromagnet. Attached to the armature of the electromagnet there is a rod, bar, slide or coupling, which rod is fork-shaped in its projecting area so that it engages a connecting pin between the truck and the element below the truck. Thus, the entire element moves in the guide rail as specified by the desired program. The coupling device and the identification system are supplied with the corresponding signals and the required power either via wiper or sliding contacts or via a trailing cable. The identification system can thereby be a sensor, e.g. a proximity switch. Optical systems, magnets with corresponding reed contacts or other types of switches can also be used.

German Patent No. 31 48 464 C2 teaches the use of a device for moving movable suspended partitions. Such a known device uses guide rails, which guide rails are realized in intersecting T-shaped or Y-shaped patterns or curves, to park the various partitions in the corner of a room.

German Patent No. 72 47 479 U1 teaches the use of an acute angle junction. At this junction, one of the two carrier devices enters the branch rail, while the second carrier device of the wall element continues to move in the straight guide rail.

A similar junction is disclosed in German Patent No. 21 08 593 A1.

The guide rails, which guide rails are designed on the basis of the distance to be travelled by the movable wall elements from the yard into the closed position, are turned in a 90 degree curve in the vicinity of the room opening to be closed, to make it possible for the movable wall elements to be pivoted from the parked position into the closed position. one problem caused by this curvature of the guide rails is that the last movable wall element in the direction of the closing movement must be moved into the room opening until it has been fully pivoted into its final position. In the final position, the last movable wall element is flush with the other movable wall elements. For this reason, an open gap remains in the vicinity of the above-mentioned curve of the guide rail, even after the final movable wall element is in the closed position of the movable wall.

In similar known movable wall systems, a wide variety of devices have been used to close this gap. The most common remedial measure is to provide a door-like pivoting closing shutter in this vicinity. Such a shutter has an unattractive appearance, however, and must, in every respect, be considered a makeshift solution. The known art also teaches the use of an additional guide rail which corresponds only to the final movable wall element, and guides only this movable wall element into the closed position. This guide rail ends in this vicinity and is not curved into a curve which bring the element in line with the closed wall. This solution entails a variety of technical problems, and in spite of the added effort and expense, it is still not satisfactory.

OBJECT OF THE INVENTION

The object of the present invention is to create a movable wall which makes possible a complete closing of a room opening in the vicinity of the final movable wall element to be moved into the room opening.

SUMMARY OF THE INVENTION

The present invention teaches that this object can be accomplished in accordance with at least one possible embodiment, by an arrangement in which at least the final moving wall element in the direction of the closing motion of the movable wall is mounted on support and guidance elements. At least the rear support and guidance element, in the direction of the closing motion, is mounted on the movable wall element so that the rear support and guidance element can be moved in the closing direction. The guide rail is provided with a curve, which curve is adjacent to the terminal area, and a guide rail portion, which guide rail portion is adjacent to the curve.

To close a movable wall in the facade, without the requirement for separate closing elements, in addition to the movable wall elements, such as shutters or doors, the present invention teaches the use of a special arrangement of the guide rails and a special connection or attachment of the final movable wall element to be closed.

The layout, location or orientation of the guide rails, which guide rails are fastened to the underside of the ceiling of the building, is not U-shaped in the parking or railroad yard area, as in known realizations described above, but is extended in a curve with an adjoining straight section which runs in the parking direction of the other movable wall elements. Only one movable wall element moves in this curve and the 90 degree curved segment, namely the wall element which enters into the parked position first. All the other movable wall elements enter the railroad yard with one of their suspensions in a junction or branch line. The individual movable wall elements can be moved manually or can be motorized. The following discussion, however, relates only to the motorized realization, because such a realization is easier for the operating personnel to operate.

In the motor-driven realization, each movable wall element is equipped with a separate electric motor. The present invention teaches that the final closing element can be provided with an additional drive motor. Thus, there are drive motors on both of the support and guidance elements. While one support and guidance element is connected only rotationally with the movable wall element, the second support and guidance element can also be moved inside the movable wall element in the longitudinal direction of the element. In particular, the second support and guidance element can be moved inside the movable wall element by a truck.

If the movable wall is to be closed, the movable wall element which is parked closest to the wall of the building is the last one moved out of the parked position. As a result of the drive applied by the electric motor to the immobile support and guidance element, the movable wall element is moved or pulled out of the parked position in the railroad yard, and, in particular, via the additional curve, is moved into the guide rail for the facade. After the immobile or first support and guidance element has reached a defined position which is actuated by the control system for the electric motors, the second electric motor is also energized. As a result, the end of the movable wall element is also pushed and pivoted, namely because the leading edge of the element is already pressing against the other elements, which other elements are in alignment. Simultaneously, however, on account of the kinematics of the system, the truck present in the element, to which truck the second drive unit with the second electric motor is connected, moves toward the first support and guidance element. On account of the curvature of the guide rail, that means that the end of the movable wall element is pushed into the facade and thus closes the facade.

In other words, and in accordance with one possible embodiment of the present invention, the motor for the second support and guidance element can be actuated by the control system after the first support and guidance element reaches a defined position in the guide rail. The defined position in the guide rail for the first support and guidance element can be determined in several different ways. One way to determine the defined position is to preferably place a position detector or sensor in the guide rail. This position detector can then be activated when the first support and guidance element passes the detector to signal that the defined position for the first support and guidance element has been reached. Another way to determine the defined position in the guide rail is to preferably count the number of turns or revolutions made by the motor in moving the first support and guidance element. The defined position in the guide rail is preferably reached when the counted number of turns of the motor equals a predetermined total corresponding to the defined position in the guide rail. Other ways of detecting when the first support and guidance element reaches the determined position in the guide rail may also be used. Once the first support and guidance element reaches the defined position in the guide rail, the first support and guidance element is preferably held in the defined position in the guide rail while the second support and guidance element is moved by a second motor to pivot the final wall element into the closed position.

In one embodiment of the present invention, it is also possible to equip the final movable wall element with only one electric motor, like the other movable wall elements. This electric motor is installed on the support and guidance element which interacts with the truck, which truck is present in or on the movable wall element. This movable wall element is pulled into the railroad yard when the wall is opened, and is pushed out of the railroad yard when the wall is closed. These operations are possible only if there is at least one spring element on the truck. If the movable wall element is to be moved into the closed position, beginning at the position in which the forward edge of the movable wall element impacts the movable wall element which is already in the closed position, the electric motor must overcome the force of the spring element and move the movable wall element into the closed position. This sequence of operations is possible because the support and guidance element can move even when the movable wall element is stationary. In addition to the ability to be moved by an electric motor, the movable wall element can also be moved by a linkage, or it can also be moved manually.

The above discussed embodiments of the present invention will be described further hereinbelow with reference to the accompanying figures. When the word "invention" is used in this specification, the word "invention" includes "inventions", that is, the plural of "invention".

BRIEF DESCRIPTION OF THE DRAWINGS

The present invention is explained in greater detail below with reference to the embodiments illustrated in the accompanying drawings, wherein.

DESCRIPTION OF THE PREFERRED EMBODIMENT

Figure 1:
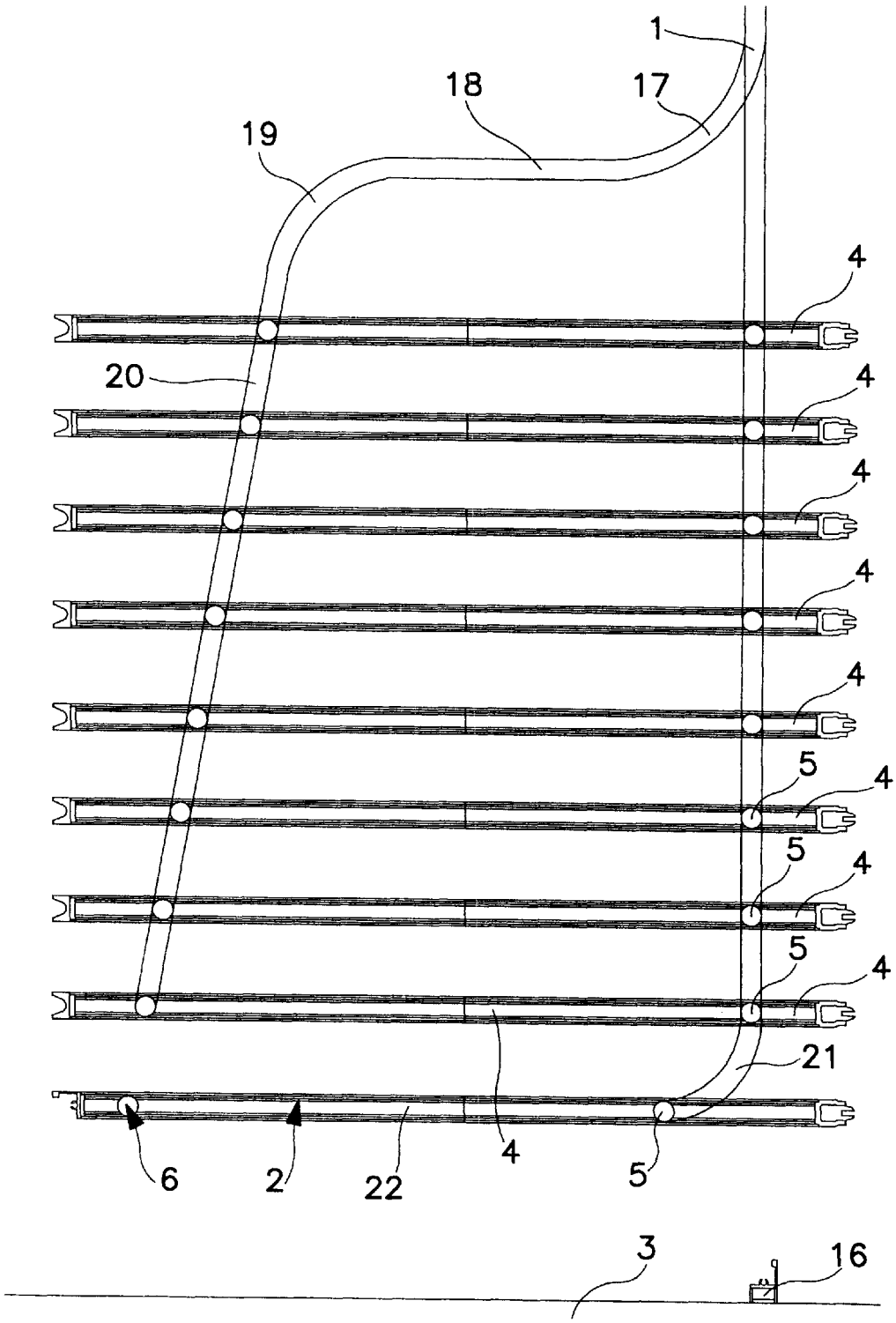
FIG. 1 shows parked movable wall elements of an open movable wall system.

The present invention can involve a total of nine movable wall elements 2, 4 in an open movable wall system as illustrated in FIG. 1. The movable wall elements 2, 4 can be parked in a railroad yard when the wall system is open. A movable wall element 2 is preferably located on the end of a guide rail 1. The guide rail 1 can be divided in two in the vicinity of the railroad yard. The movable wall element 2 is preferably important for the present invention, because the movable wall element 2 is preferably the final movable wall element to arrive in position when the movable wall is closed. In the vicinity of the room opening to be closed, which opening can be located between two walls of the room, one room wall 3 of which is shown in FIG. 1, the guide rail 1 can be routed along a curve 21 on the end of the facade where the curve 21 carves by 90 degrees, and can then continue into an extending rail 22. The extending rail 22 is approximately parallel to the wall 3 of the room. It is thereby possible to pivot the movable wall element 2 into the closed position.

Figure 5:
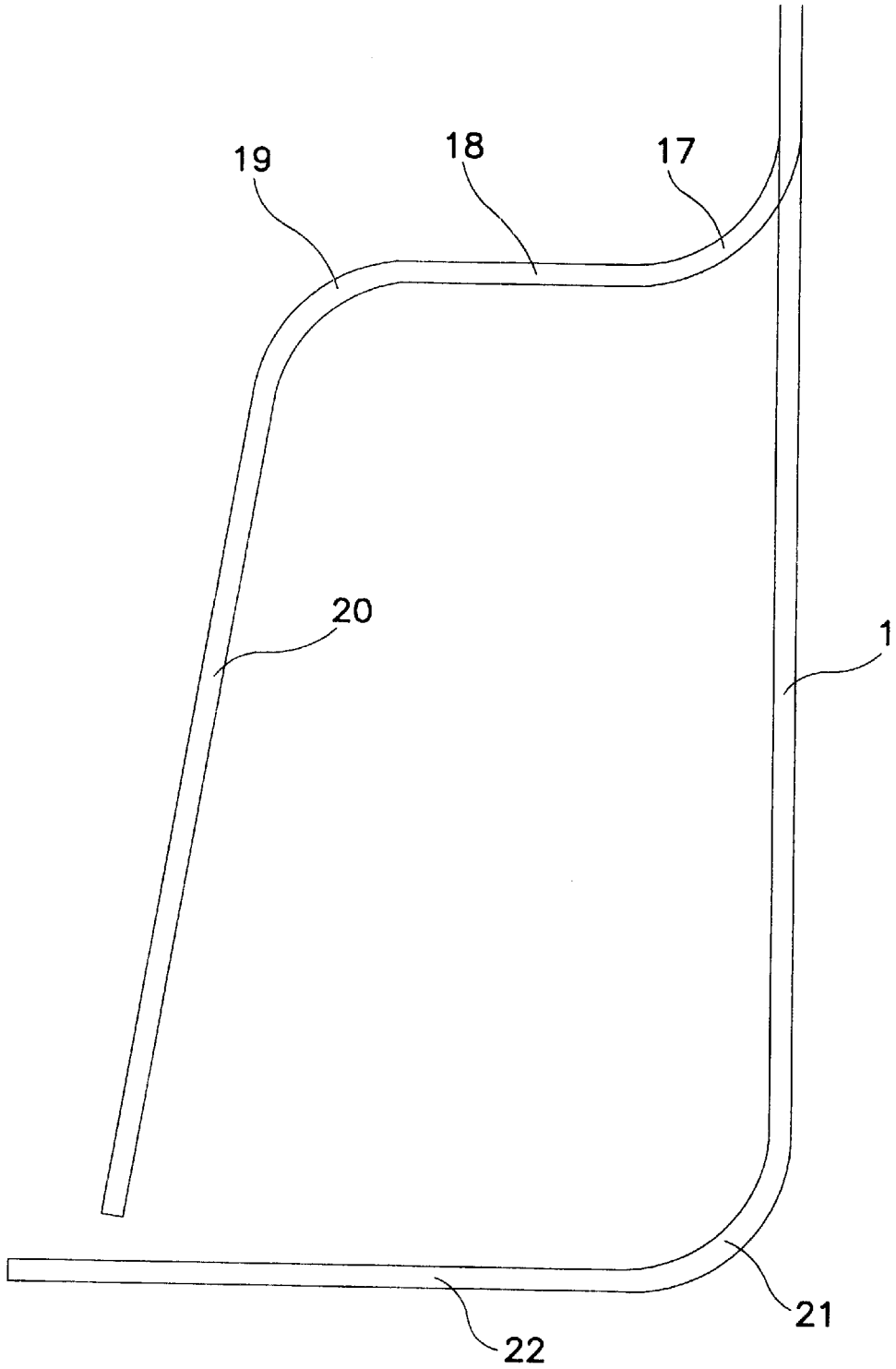
FIG. 5 illustrates the path of the guide rails.

FIG. 5 illustrates the total path of the guide rails. To move all the movable wall elements 4 into the railroad yard, there can be a side guide rail 17. The side guide rail 17 can branch off from the guide rail 1. The side guide rail 17 can connect to a railroad yard entry 18. The railroad yard entry 18 can be adjacent to a curve 19 and a straight guide rail 20.

It should be noted here that the movable wall elements 2, 4 can be mounted on the floor of the room, but, the movable wall elements 2, 4 can also be mounted on the ceiling of the room. The ceiling guide rail 1 is more complex and expensive, however, because the movable wall elements 2, 4 are suspended from the ceiling guide rail 1. In addition, if the movable wall elements 2, 4 are driven by motors, the drive system must preferably be located on the ceiling.

Figure 6:
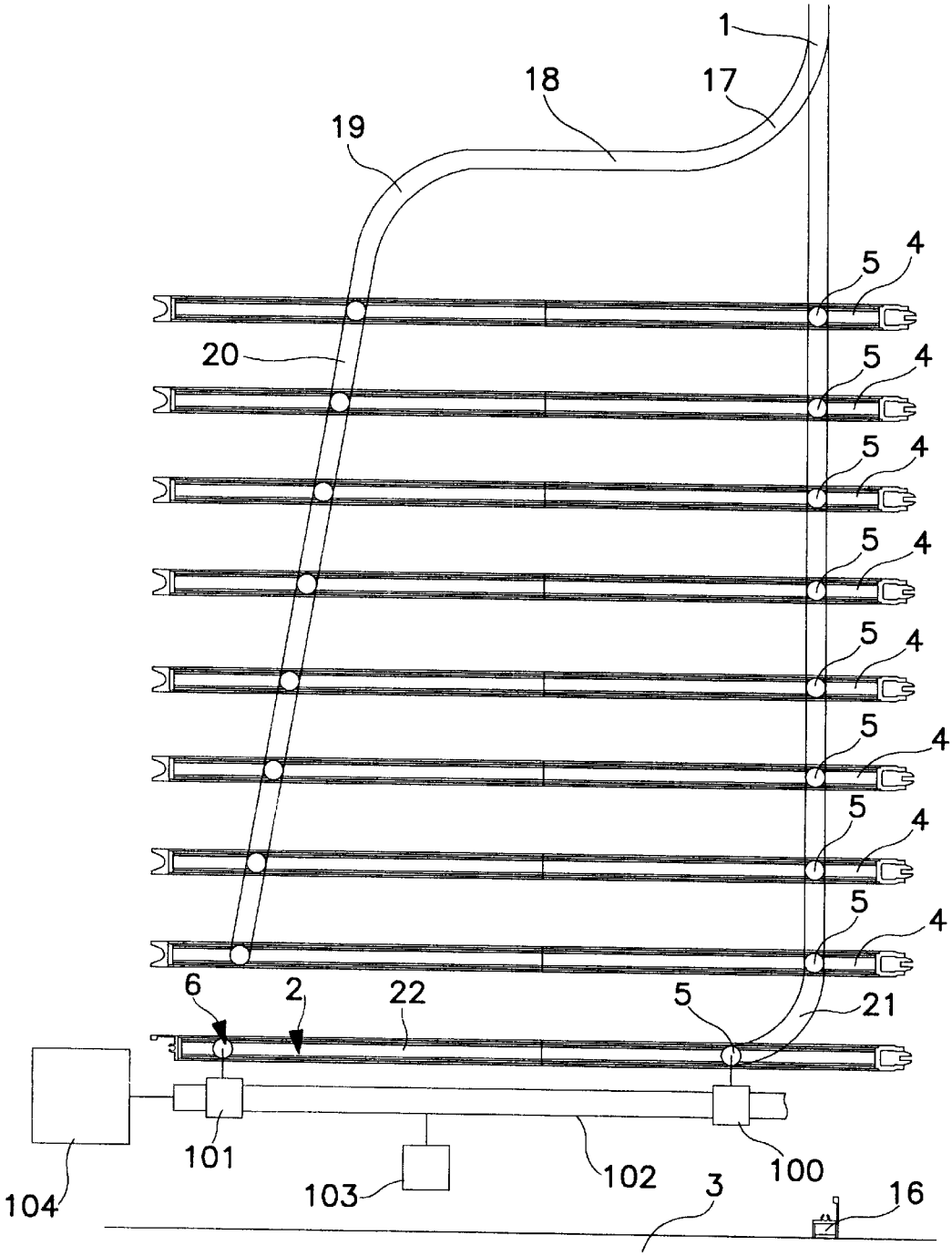
FIG. 6 illustrates additional details of the movable wall system in FIG. 1.

The movable wall elements 4 can be suspended on at least two support and guidance elements 5, whereby there is preferably a drive unit on at least one support and guidance element 5. The movable wall element 2, in addition to the support and guidance element 5, preferably has an additional support and guidance element 6. On the support and guidance element 5, there can be a drive unit 100 (see FIG. 6). The purpose of the drive unit 100 is to preferably transport the movable elements 2, 4 in a known manner into the room opening. The second support and guidance element 6, which support and guidance element 6 is the rear element in the closing direction, can have a second, additional drive unit 101 (see FIG. 6), i.e. the movable wall element or unit 2 can preferably always be provided with two drive units.

Figure 3:
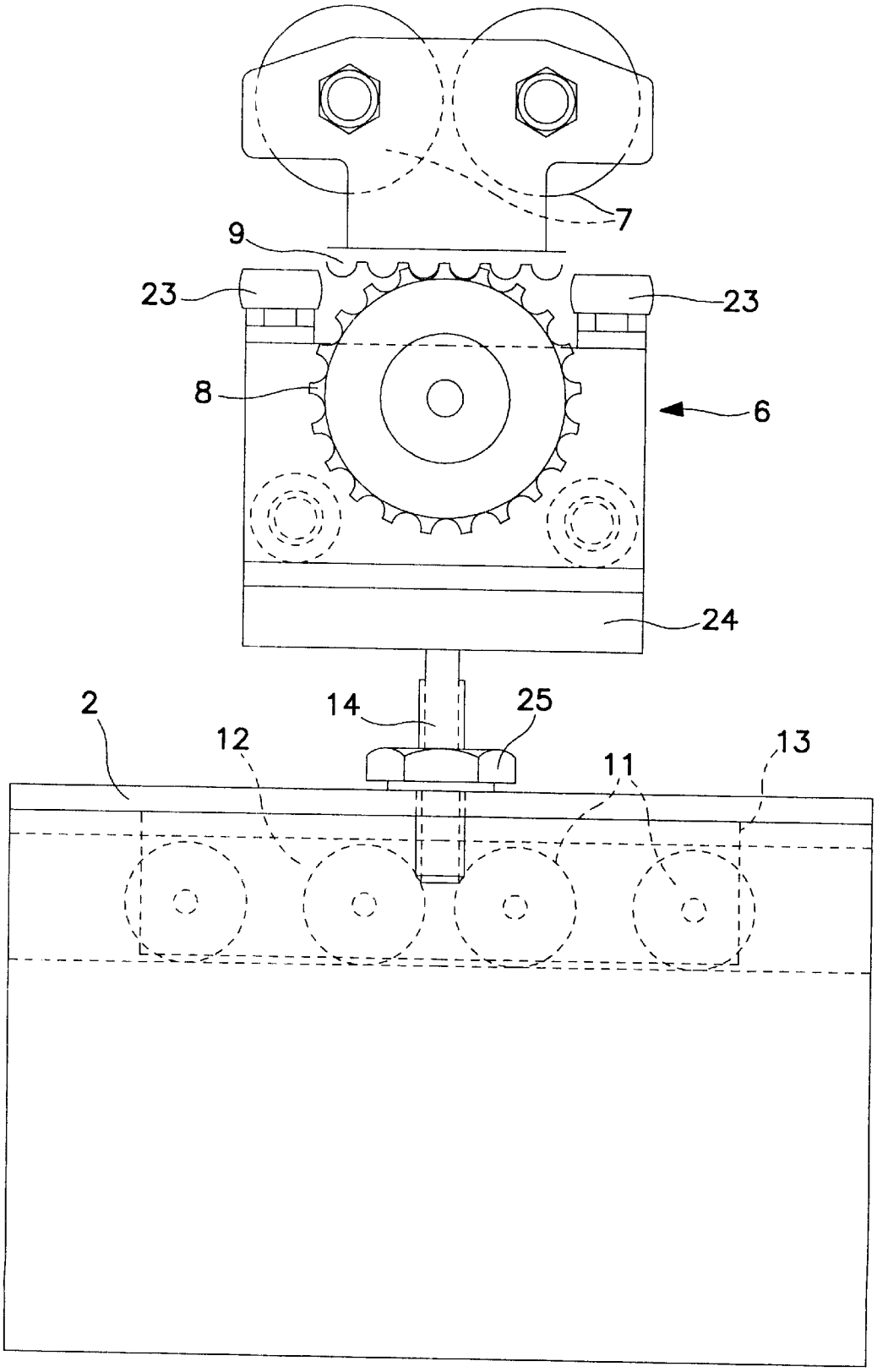
FIG. 3 illustrates a drive unit of a movable wall element.
Figure 4:
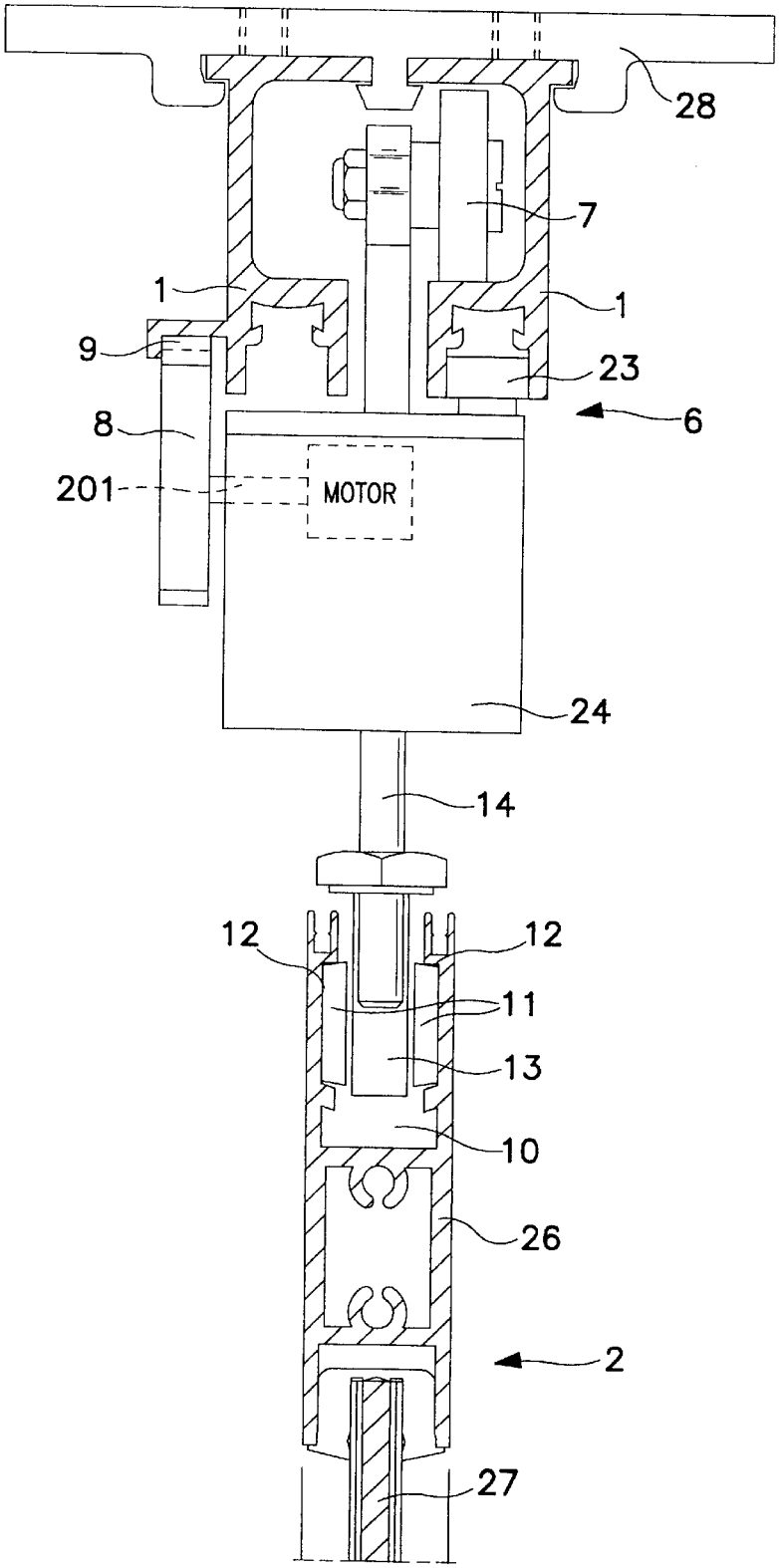
FIG. 4 illustrates the suspension and attachment of a movable wall element.

The guide rail 1 illustrated in FIG. 4 can essentially be C-shaped, and can be fastened to the ceiling by a ceiling fastener 28. The upper end of the movable wall element 2 can be mounted on the guide rail 1 by the respective support and guidance elements 5, 6. The support and guidance elements 5, 6 can have at least one support roller 7 and one guidance roller 23. The drive for drive units 100, 101 (see FIG. 6) is preferably supplied by an electric motor. The electric motor is preferably realized in the form of a direct current motor. On the drive shaft 201 of the motor there is a drive pinion 8 (see FIG. 3). The drive pinion 8 can be designed to mesh with a toothed belt 9 (see FIG. 3). The toothed belt 9 can be located in a stationary manner on the guide rail 1 . The toothed belt 9 can preferably extend over the length of the guide rails 1, 17, 18, 19, 20, 21 and 22. As a result of the rotation of the drive pinion 8, the support and guidance elements 5, 6 can therefore be moved along the guide rails 1, 17, 18, 19, 20, 21 and 22. The power can be supplied and the drive or electric motors can be actuated via a bus bar 102 (see FIG. 6). The bus bar 102 can run parallel to the guide rails 1, 17, 18, 19, 20, 21 and 22, and can have current collectors 103 (see FIG. 6).

In particular, as illustrated in FIG. 4, the second support and guidance element 6 can be realized so that portions of the second support and guidance element 6 are disposed along the guide rail 1, while other portions of the second support and guidance element extend out of and beyond the guide rail 1, even if by a limited amount The second support and guidance element 6 can extend into a guide channel or trough 10, which guide channel 10 can be inside a cover profile 26. The second support and guidance element 6 can be moved along the upper edge of the movable wall element 2. For this purpose, the support and guidance element 6 is preferably provided with at least one roller 11, which at least one roller 11 can move in the guide channel 10. In one embodiment there are preferably a total of eight rollers 11, whereby the guide channel 10 is shaped so that the movable wall element 2 is suspended from the guide channel 10 and hangs underneath the guide channel 10. For this purpose, the guide channel 10 has two lateral depressions 12, which depressions 12 extend over the longitudinal direction of the guide channel 10. In the depressions 12 the rollers 11 can move. A truck 13 for the rollers 11 is thereby realized so that the truck 13 can be mounted rotationally on a pin or bolt 14. The pin 14 for its part can be connected to a portion of the support and guidance element 6 by a locknut 25 (see FIG. 3). The portion of the support and guidance element 6 can contain rollers 7, which rollers 7 are preferably designed to engage in the guide rails 1, 21, 22.

Figure 2:
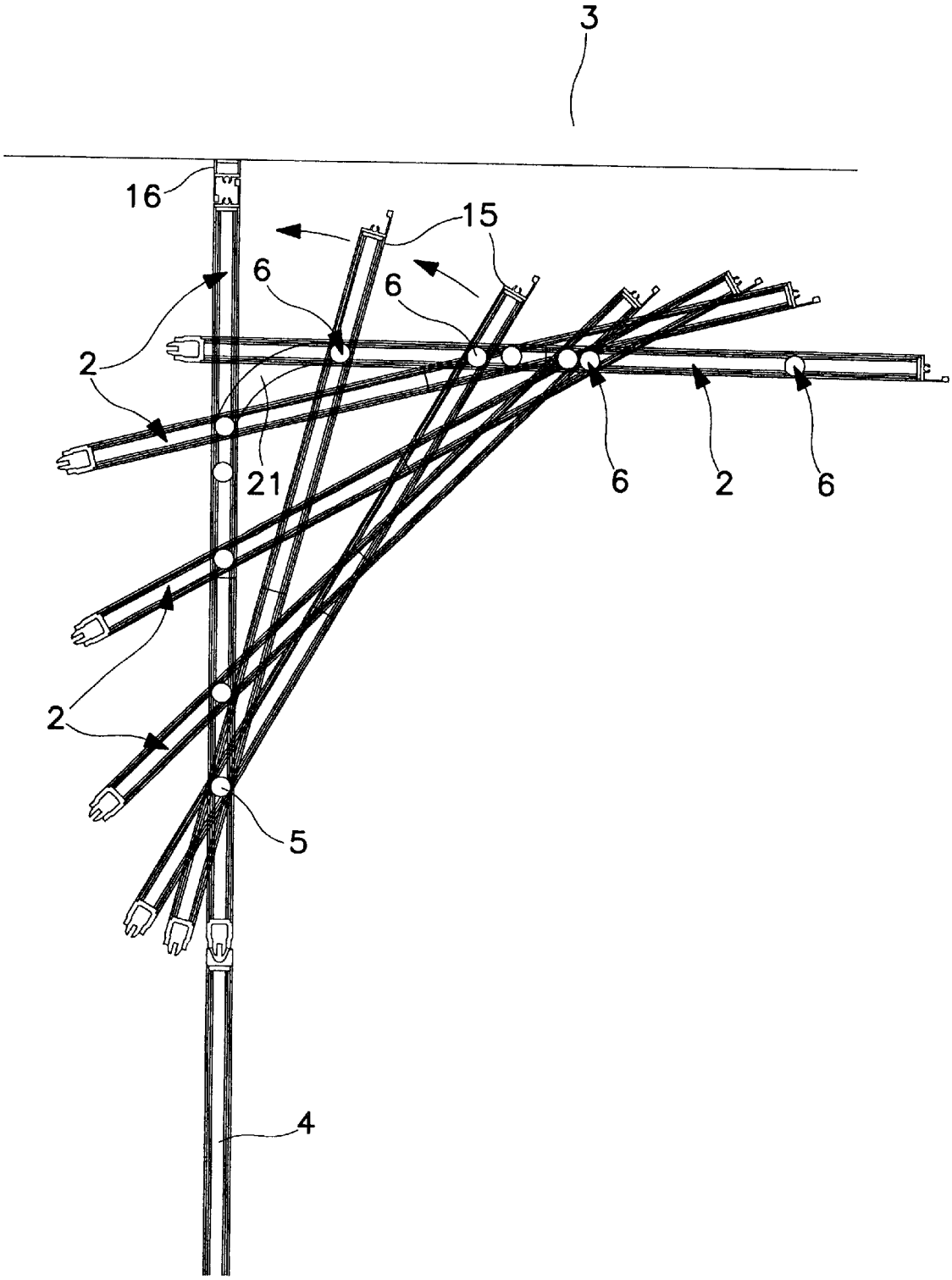
FIG. 2 illustrates the process of pivoting the final movable wall element into the closed position.

When the movable wall is closed, the individual movable wall elements 4 are preferably moved into the closed position one after another. Then, as illustrated in FIG. 2, when the final movable wall element 2 enters the vicinity of the room opening to be closed, i.e. the vicinity of the curve 21 of the guide rail 1, the following sequence of events can occur. After the first support and guidance element 5 in the closing direction has passed the guide rail curve 21 and is in the straight portion of the guide rail 1, which guide rail 1 can preferably define the closed position of the movable wall, the second support and guidance element 6, which second support and guidance element 6 has been pulled to that point, can reach the beginning of the curve 21. An electric control system 104 (see FIG. 6) can then actuate the electric motor of the support and guidance element 6. The motor can be used to drive the pinion E so that the movable wall element 2 is preferably pushed from behind into the closed position. The movable wall element 2 can thereby be in contact by its forward edge with the preceding movable wall element 4, or the movable wall element 2 can be braked by a corresponding actuation of the first support and guidance element 5.

In other words and in accordance with one possible embodiment of the present invention, the second support and guidance element 6 can, along with the movable wall element 2, follow or be pulled by the electric motor connected to the first support and guidance element 5. Then, when the first support and guidance element 5 reaches a determined point in the guide rail 1, the first support and guidance element 5 can be held in place at the determined point. The electric motor for the second support and guidance element 6 can be actuated by the control system 104 and can begin to move the second support and guidance element 6. The moving of the second support and guidance element 6 can preferably pivot or push the movable wall element 2 into the closed position. The first support and guidance element 5 can be held at the determined point in the guide rail 1 by a device that attaches to the first support and guidance element 5 when the determined point is reached. Another way to hold the first support and guidance element 5 in place in the guide rail 1 can be to actuate the motor connected to the first support and guidance element 5 with the control system 104 to counteract any possible movements of the first support and guidance element 5 from the determined point in the guide rail 1.

The second support and guidance element 6 can move forward along the curve 21 out of the guide rail 22 and then into the guide rail 1. The second support and guidance element 6 can thereby also be moved forward inside the guide channel 10 on the upper edge of the moving wall element 2, so that the distance between the support and guidance element 6 and a rear edge 15 of the moving wall element 2 increases. Consequently, this rear edge 15, as indicated by an arrow, is preferably swivelled around until it comes into contact with a closing stop 16, which closing stop 16 is fastened to the wall 3 of the room. At this point, the movable wall element 2, which movable wall element 2 is the last one to move during the closing process, can be pivoted completely into its final position in which the movable wall element 2 is flush with the other movable wall elements 4.

In the vicinity of the closing stop 16, there is no longer any gap which needs to be closed with shutters or other auxiliary equipment. The lateral closure of the movable wall therefore creates a very attractive appearance, even when the movable wall is closed. In the vicinity of the closing stop 16, it is also a simple matter to provide locks, so that the movable wall as taught by the present invention also offers advantages from the point of view of security. It is also possible, however, to secure the closing of the movable wall by locking the support and guidance element 6, which locking can preferably be actuated electrically or electronically.

The movable wall is preferably realized so that not only the support and guidance element 6, but at least the rear support and guidance element of the other movable wall elements 4 in the closing direction can be moved along the upper edge of the respective movable wall element 2, 4. In particular in the vicinity of the railroad yard as illustrated in FIG. 1, this arrangement has advantages in terms of the movement and compact parking of the movable wall elements 2, 4. The railroad yard can be located in the vicinity of the room opening to be closed, so that when the wall is open, the movable wall elements 2, 4 are parallel to one of the walls of the room. The railroad yard can also be located to one side, behind a corner, or even in its own narrow room or space. It goes without saying that analogous to the ceiling guide rails 1, 17, 18, 19, 20, 21 and 22 of the support and guidance elements 5, 6 described above, there can also be a guidance system in the vicinity of the floor. It is also within the context of the present invention to design the movable wall by incorporating technical details which are different from those of the embodiment described above.

The movable wall elements 2, 4 described above can be made of a variety of materials. Specifically for use on store facades, however, the closing profile 26 is provided with a glass plate 27 as shown in FIG. 4.

Figure 7:
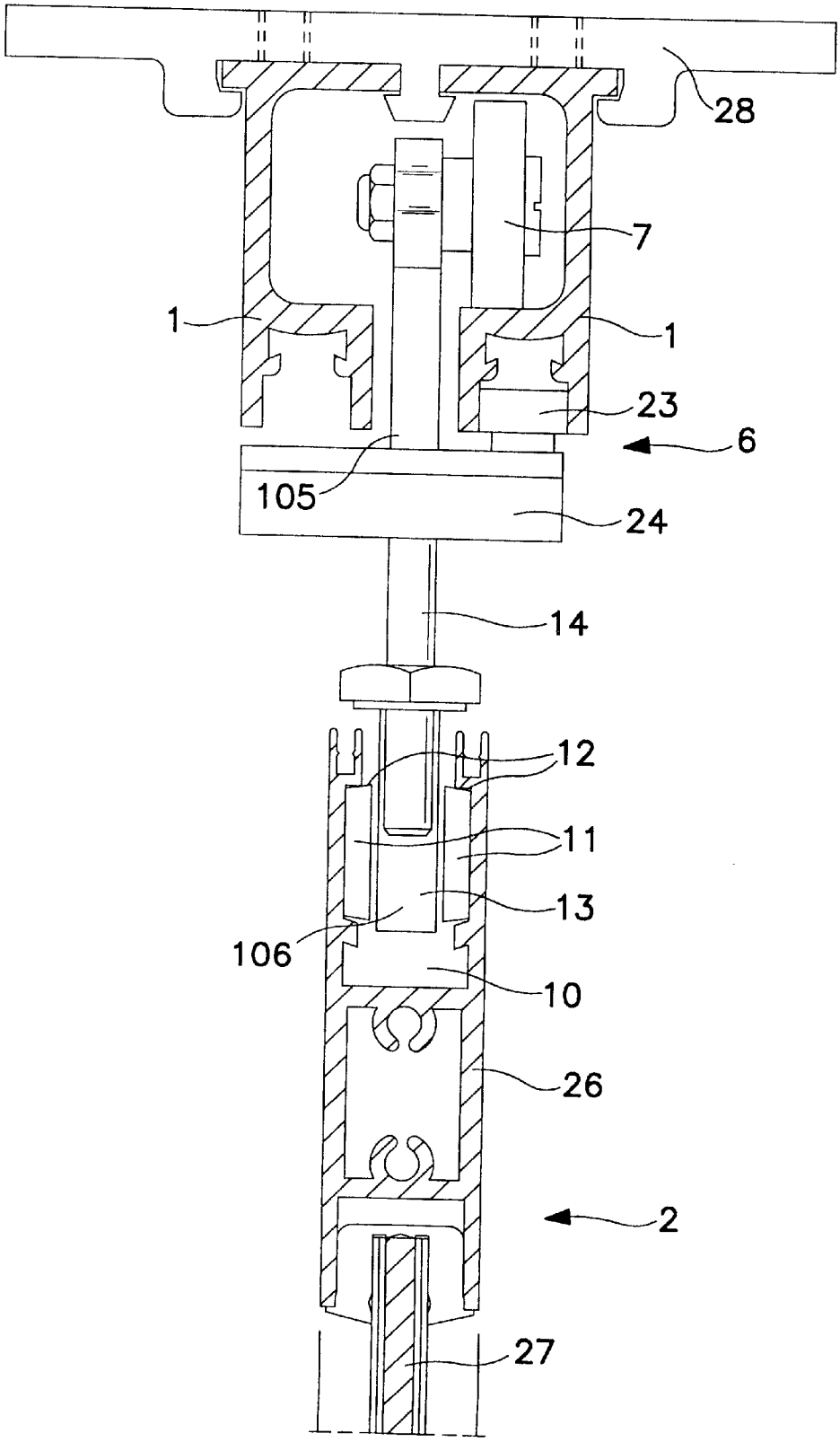
FIG. 7 illustrates additional features of the suspension and attachment of the movable wall element in FIG. 4.

In another possible embodiment of the present invention as illustrated in FIG. 7, the electric motor for the second support and guidance element 6 can be connected at 105. The second support and guidance element 6 can also have a suspension 24. The suspension 24 can be used to stabilize the second support and guidance element 6. The suspension 24 can also be used to permit the second support and guidance element 6 to pivot or rotate with respect to the movable wall element 2. In addition, a spring element or elements could possibly be attached to the truck 13 of the second support and guidance element 6 at 106. The spring elements could possibly be used in conjunction with a motor connected only to the second support and guidance element 6 to assist in the moving of the final movable wall element 2 between the parked position and the closed position.

One feature of the invention resides broadly in the movable wall which has at least two movable wall elements 2, 4 which are mounted so that they can move on at least one stationary, horizontal guide rail 1 by means of support and guidance elements 5, 6, characterized by the fact that at least the final moving wall element 2 in the direction of the closing motion of the movable wall is mounted on support and guidance elements 5, 6, at least the rear support and guidance element 6 in the direction of the closing motion is mounted on the movable wall element 2 so that the rear support and guidance element 6 can be moved in the direction of the movable wall element 2, and the guide rail 1 is provided with a curve 21 which is adjacent to the terminal area and a guide rail 22 which is adjacent to the curve 21.

Another feature of the invention resides broadly in the movable wall characterized by the fact that the rear support and guidance element 6 of the final movable wall element 2 in the direction of the closing movement has its own drive unit, whereby during the closing process, this final movable wall element 2 can be moved automatically into the closed position in which it is flush with the other movable wall elements 4.

Yet another feature of the invention resides broadly in the movable wall characterized by the fact that. the support and guidance element 6 is mounted so that it can move in a guide channel 10 which is located on a movable wall element 2.

Still another feature of the invention resides broadly in the movable wall characterized by the fact that the support and guidance element 6 has at least one truck 13 which has at least one roller 11, which truck 13 can move in the guide channel 10.

A further feature of the invention resides broadly in the movable wall characterized by the fact that the truck 13 is provided with at least one spring element, the force of which is overcome manually or by a drive unit during the closing of the movable wall element 2.

Another feature of the invention resides broadly in the movable wall characterized by the fact that the guide channel 10 of the movable wall element 2 is realized so that the movable wall element 2 is mounted by being suspended on the roller 11 of the support and guidance element 5, which roller 11 projects or extends into the guide trough 10.

Yet another feature of the invention resides broadly in the movable wall characterized by the fact that the support and guidance element 6 is realized so that the movable wall element 2 can be pivoted with respect to the guide rail 1.

Still another feature of the invention resides broadly in the movable wall characterized by the fact that the support and guidance elements 5 are provided with a drive unit.

A further feature of the invention resides broadly in the movable wall characterized by the fact that the drive unit has an electric motor, the drive shaft of which is provided with means by which, by interacting with a contact surface or a contract profile located along the guide rail 1, 21, 22 or approximately parallel to it, the support and guidance elements 5, 6 or the movable wall elements 2, 4 can be moved along the guide rails.

Another feature of the invention resides broadly in the movable wall characterized by the fact that a drive pinion 8 is non-rotationally mounted on the drive shaft of the electric motor, whereby the drive pinion 8 is designed to mesh with a toothed contact profile 9 which consists of a toothed belt located in a corresponding recess which extends along the guide rail 1.

Yet another feature of the invention resides broadly in the movable wall characterized by the fact that there is a control system which controls the power supply and the sequence of operations by means of bus bars and current collectors.

Another feature of the invention resides broadly in a movable wall system comprising: at least two wall elements; each of said at least two wall elements being configured to be disposed in a first position to park each of said at least two wall elements in an open position; each of said at least two wall elements being configured to be disposed in a second position to at least partially close an opening; said at least two wall elements comprising a first wall element and a second wall element; a rail to accept at least said first wall element; said first wall element comprising an arrangement to mount said first wall element on said rail; said mounting arrangement of said first wall element being configured and disposed to permit said first wall element to move along said rail between said first position and said second position; said first wall element comprising a first edge and a second edge disposed opposite to said first edge; said :first edge of said first wall element being configured to be disposed at least adjacent to a wall without a substantial gap between said first edge of said first wall element and a wall disposed adjacent to said first edge of said first wall element upon said first wall element being disposed in said second position; said mounting arrangement of said first wall element comprising a structure to support and guide said first wall element on said rail; said support and guidance structure being disposed towards said first edge of said first wall element; said support and guidance structure being configured and disposed to permit movement of said first wall element into said second position; said rail comprising a first portion and a second portion; said first portion of said rail being curved; and said first portion of said rail being configured and disposed to permit said first edge of said first wall element to be moved at least adjacent to a wall without a substantial gap between said first edge of said first wall element and a wall disposed adjacent to said first edge of said first wall element.

Yet another feature of the invention resides broadly in the movable wall system wherein: said rail comprises a first end and a second end; said first end of said rail is disposed a first distance from a wall disposed adjacent to said first end of said rail; said second end of said rail is disposed a second distance from a wall disposed adjacent to said first end of said rail; said second distance is substantially greater than said first distance; and said first portion of said rail is disposed adjacent to said first end of said rail.

Still another feature of the invention resides broadly in the movable wall system wherein: said second portion of said rail is disposed adjacent to said first portion of said rail; said second portion of said rail is disposed substantially parallel to a wall disposed adjacent to said first end of said rail; and said first wall element is configured to be disposed on said second portion of said rail upon said first wall element being disposed in said first position.

A further feature of the invention resides broadly in the movable wall system wherein: said support and guidance structure comprises a drive unit; said drive unit is configured and disposed to automatically move said first wall element into said second position upon said first wall element being moved from said first position to said second position; and said first wall element and said second wall element are configured to be substantially flush with one another upon both said first wall element and said second wall element being disposed in said second position.

Another feature of the invention resides broadly in the movable wall system wherein: said first wall element comprises a channel; said channel Ls disposed substantially parallel to said rail; and said support and guidance structure is configured and disposed to move in said channel of said first wall element.

Yet another feature of the invention resides broadly in the movable wall system wherein said support and guidance structure is configured to permit said first wall element to pivot with respect to said rail.

Still another feature of the invention resides broadly in the movable wall system wherein: said support and guidance element comprises at least one truck; said at least one truck is configured and disposed to move in said channel of said first wall element; said at least one truck comprises at least one roller; said at least one roller of said at least one truck is configured and disposed to extend into said channel of said first wall element; and said channel of said first wall element is configured to permit suspending of said first wall element on said at least one roller to mount said first wall element on said rail.

A further feature of the invention resides broadly in the movable wall system wherein: said support and guidance structure is a first support and guidance structure; said drive unit is a first drive unit; said mounting arrangement of said first wall element comprises a second support and guidance structure; said second support and guidance structure is disposed adjacent to said second edge of said first wall element; and said second support and guidance structure comprises a second drive unit.

Another feature of the invention resides broadly in the movable wall system further comprising: a surface; said surface being disposed one of a) and b): a) substantially parallel to said rail; and b) along said rail; said surface comprising a toothed profile; said first drive unit and said second drive unit each comprising an electric motor; said electric motor of each of said first drive unit and said second drive unit comprising a drive shaft; said electric motor of each of said first drive unit and said second drive unit comprising a drive pinion; said drive pinion of said electric: motor of each of said first drive unit and said second drive unit being non-rotationally mounted on said drive shaft of said electric motor; and said drive pinion of said electric motor of each of said first drive unit and said second drive unit being configured and disposed to mesh with said toothed profile to move one of said first support and guidance structure, said second support and guidance structure and said first wall element on said rail.

Yet another feature of the invention resides broadly in the movable wall system further wherein: said toothed profile comprising a toothed belt; said rail comprising a recess; said recess of said rail being disposed along said rail; said toothed belt being disposed in said recess of said rail; a control system to control operation of both said first drive unit and said second drive unit; said control system comprising: at least one bus bar; at least one current collector; and a power supply for both said first drive unit and said second drive unit; and said control system being configured to sequence operation of said first drive unit and said second drive unit.

Still another feature of the invention resides broadly in the movable wall system further comprising: an additional rail; said additional rail being configured and disposed to branch from said rail; said at least two wall elements comprising at least one third wall element; said at least one third wall element being disposed adjacent to said second wall element; each of said second wall element and said at least one third wall element being partially disposed on both said rail and said additional rail upon each of said second wall element and said at least one third wall element being disposed in said first position; each of said second wall element and said at least. one third wall element comprising an arrangement to move each of said second wall element and said at least one third wall element between said first position and said second position; and said arrangement to move each of said second wall element and said at least one third wall element comprising at least two third support and guidance structures and at least one third drive unit.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A movable wall system comprising:

at least two wall elements;

each of said at least two wall elements being configured to be disposed in a first position to park each of said at least two wall elements in an open position;

each of said at least two wall elements being configured to be disposed in a second position to at least partially close an opening;

said at least two wall elements comprising a first wall element and a second wall element;

a rail being configured to mount at least said first wall element thereon;

said first wall element comprising an arrangement to mount said first wall element on said rail;

said mounting arrangement of said first wall element being configured and disposed to permit said first wall element to move along said rail between said first position and said second position;

said first wall element comprising a first edge and a second edge disposed opposite to said first edge;

said mounting arrangement of said first wall element comprising a structure to support and guide said first wall element on said rail;

said support and guidance structure being disposed towards said first edge of said first wall element;

said support and guidance structure being configured and disposed to permit movement of said first wall element into said second position;

said rail comprising a first portion and a second portion;

said first portion of said rail being curved;

said first portion of said rail being configured and disposed to permit said first edge of said first wall element to be moved at least adjacent to a wall without a substantial gap between said first edge of said first wall element and the wall;

said rail comprises a first end and a second end;

said first end of said rail is configured to be disposed a first distance from the wall;

said second end of said rail is configured to be disposed a second distance from the wall;

said second distance is substantially greater than said first distance;

said first portion of said rail is disposed adjacent to said first end of said rail;

said second portion of said rail is disposed adjacent to said second end of said rail;

said second portion of said rail is configured to be;

said first wall element is configured to be disposed on said second portion of said rail upon said first wall element being disposed in said first position;

said support and guidance structure comprises at least one drive unit;

said at least one drive unit being permanently attached to said first wall element to drive said first wall element;

said at least one drive unit automatically moves said first wall element into said second position only after said first wall element passes a predetermined point on said rail between said first position and said second position;

said first wall element and said second wall element are substantially flush with one another upon both said first wall element and said second wall element being disposed in said second position.

2. The movable wall system according to claim 1, wherein:

said first wall element comprises a channel; and said support and guidance structure is configured and disposed to move in said channel of said first wall element.

3. The movable wall system according to claim 2, wherein said support and guidance structure is configured to permit said first wall element to pivot with respect to said rail.

4. The movable wall system according to claim 3, wherein:

said support and guidance structure comprises at least one truck;

said at least one truck is configured and disposed to move in said channel of said first wall element;

said at least one truck comprises at least one roller;

said at least one roller of said at least one truck is configured and disposed to extend into said channel of said first wall element; and said channel of said first wall element is configured to permit suspending of said first wall element on said at least one roller to mount said first wall element on said rail.

5. The movable wall system according to claim 4, wherein:

said support and guidance structure is a first support and guidance structure;

said drive unit is a first drive unit;

said mounting arrangement of said first wall element comprises a second support and guidance structure;

said second support and guidance structure is disposed adjacent to said second edge of said first wall element; and said second support and guidance structure comprises a second drive unit.

6. The movable wall system according to claim 5, further comprising:

a surface;

said surface being disposed one of a) and b):

a) substantially parallel to said rail; and b) along said rail;

said surface comprising a toothed profile;

said first drive unit and said second drive unit each comprising an electric motor, said electric motor of each of said first drive unit and said second drive unit comprising a drive shaft;

said electric motor of each of said first drive unit and said second drive unit comprising a drive pinion;

said drive pinion of said electric motor of each of said first drive unit and said second drive unit being non-rotationally mounted on a respective one of said drive shafts; and said drive pinion of said electric motor of each of said first drive unit and said second drive unit being configured and disposed to mesh with said toothed profile to move a respective one of said first support and guidance structure, said second support and guidance structure and, said first wall element on said rail.

7. The movable wall system according to claim 6, further comprising:

said toothed profile comprising a toothed belt;

said rail comprising a recess;

said recess of said rail being disposed along said rail;

said toothed belit being disposed in said recess of said rail;

a control system to control operation of both said first drive unit and said second drive unit;

said control system comprising:

at least one bus bar;

at least one current collector; and a power supply for both said first drive unit and said second drive unit; and said control system being configured to sequence operation of said first drive unit and said second drive unit.

8. The movable wall system according to claim 7, further comprising:

an additional rail;

said additional rail being configured and disposed to branch from said rail;

said at least two wall elements comprising at least one third wall element;

said at least one third wall element being disposed adjacent to said second wall element;

each of said second wall element and said at least one third wall element being partially disposed on both said rail and said additional rail upon each of said second wall element and said at least one third wall element being disposed in said first position;

each of said second wall element and said at least one third wall element comprising an arrangement to move each of said second wall element and said at least one third wall element between said first position and said second position; and said arrangement to move each of said second wall element and said at least one third wall element comprising at least two third support and guidance structures and at least one third drive unit.

* * * * *